US006758307B1

(12) United States Patent
Ols

(10) Patent No.: US 6,758,307 B1
(45) Date of Patent: Jul. 6, 2004

(54) HEAVY DUTY SAWHORSE BRACE

(76) Inventor: Allen Ols, 3405 Lauer Dr., Nashville, TN (US) 37214

( * ) Notice: Subject to any disclaimer, the term of this patent is extended or adjusted under 35 U.S.C. 154(b) by 0 days.

(21) Appl. No.: 10/092,747

(22) Filed: Mar. 7, 2002

Related U.S. Application Data

(60) Provisional application No. 60/274,589, filed on Mar. 9, 2001.

(51) Int. Cl.[7] ..... E04G 1/00; E04G 1/34

(52) U.S. Cl. ..... 182/186.3; 182/153; 182/225

(58) Field of Search ..... 182/153, 151, 182/181.1, 186.3, 225, 224, 182.4, 155, 186.5, 186.2, 186.1; D25/67, 163.1, 440.1; 248/188, 188.1, 188.8, 165, 300

(56) References Cited

U.S. PATENT DOCUMENTS

| | | | | |
|---|---|---|---|---|
| 1,034,508 A | | 8/1912 | Malvolti | |
| 1,256,235 A | | 2/1918 | Jacobs | |
| 1,542,048 A | | 6/1925 | Forester | |
| 1,597,555 A | | 8/1926 | Tolmie | |
| 1,601,946 A | | 10/1926 | Dujardin | |
| 1,780,579 A | | 11/1930 | Crowley | |
| 1,797,543 A | | 3/1931 | Bryan | |
| 1,882,479 A | | 10/1932 | Brittin | |
| 1,908,858 A | | 5/1933 | O'Kane et al. | |
| 2,343,557 A | | 3/1944 | Johnson | 304/5 |
| 2,650,140 A | | 8/1953 | Boitos | 304/5 |
| 2,753,222 A | | 7/1956 | Foresta et al. | 304/5 |
| 3,082,027 A | | 3/1963 | Johnson | 287/54 |
| D211,041 S | | 5/1968 | Peterson | |
| 3,700,072 A | * | 10/1972 | Lovett | 182/225 X |
| 4,192,406 A | | 3/1980 | Mitchell | 182/185 |
| 4,226,301 A | * | 10/1980 | McDaniel et al. | 182/225 X |
| 4,238,001 A | * | 12/1980 | Alexander | 182/153 X |
| 4,298,096 A | * | 11/1981 | Prior | 182/153 X |
| 4,449,842 A | | 5/1984 | Reichman, Jr. | 403/25 |
| 4,457,399 A | | 7/1984 | Brelach | 182/185 |
| 4,565,263 A | * | 1/1986 | Southworth | 182/225 X |
| 4,574,917 A | | 3/1986 | Stoddard | 182/151 |
| 4,770,274 A | | 9/1988 | Middleton | 182/185 |
| 4,911,390 A | * | 3/1990 | Flick | 182/181.1 X |
| 5,103,933 A | | 4/1992 | Huff | 182/18 |
| 5,215,162 A | * | 6/1993 | Parks et al. | 182/153 |
| 5,377,780 A | | 1/1995 | Dunaway | 182/135 |
| 5,484,037 A | | 1/1996 | Neumarkel | 182/185 |

* cited by examiner

*Primary Examiner*—Hugh B. Thompson
(74) *Attorney, Agent, or Firm*—Waddey & Patterson; I. C. Waddey, Jr.

(57) ABSTRACT

A heavy duty sawhorse brace comprising an elongated top horizontal channel, two elongated side leg channels and a brace plate. The channels are U-shaped and configured to receive the members used to construct the sawhorse. The channels further include at least one aperture configured to receive at least one fastener for removably attaching the sawhorse members to the brace. The brace plate extends from the top horizontal channel to each side leg channel, providing increased stability. The side leg channels are oriented such that, when the sawhorse is assembled, the leg members angle away from the center of the sawhorse. The leg members at each end also angle out from each other.

16 Claims, 3 Drawing Sheets

HEAVY DUTY SAWHORSE BRACE

This application claims benefit of co-pending U.S. Patent Application Serial No. 60/274,589 filed Mar. 9, 2001, entitled "Heavy Duty Sawhorse Brace" which is hereby incorporated by reference. Be it known that I, Allen Ols, a citizen of United States, residing at 3405 Lauer Drive, Nashville, Tenn. 37214; have invented a new and useful "Heavy Duty Sawhorse Brace".

BACKGROUND OF THE INVENTION

This invention relates to a brace; more particularly, it relates to a brace useful for constructing a sawhorse with greatly increased end-to-end and side-to-side stability.

A great deal of use has been made of the sawhorse over the years. From professional carpenters to home owners, sawhorses are the widely used solution to many construction needs. Two sawhorses can be used together to support lumber while it is being cut or otherwise worked or to support a sheet of plywood to form a tabletop work surface. Sawhorses are also generally used as trestles and barricades. The characteristics of the sawhorse that contribute to its wide use include its ease of construction and disassembly, its affordability and its versatility. However there is room for improvement.

The simplest type of sawhorse is constructed out of the materials at hand, using whatever lumber is available for the cross piece and leg members of the sawhorse. The ends of the cross piece and the leg members are mitered so that they fit against each other and then nailed into place. Certainly this is a simple answer to the need for a sawhorse but it does not always result in the most satisfactory product. A sawhorse constructed in this manner is not very stable and cannot hold heavy weight loads. Nailing the legs directly into the lumber with no other means of support for the structure results in an unstable sawhorse, as the nails loosen and split the lumber when pressure is applied. It is also a dangerous solution, as it is easy to cut through the lumber being worked and into the sawhorse itself, even into the nails connecting the various members.

As the search for a safer and more stable sawhorse has progressed over time, braces and brackets were introduced to be used to join the leg members to the cross piece of the sawhorse. Many conventional sawhorses utilize a brace or bracket which connects a cross piece with four angularly disposed supporting leg members. However conventional braces have numerous shortcomings, including instability, requiring boards of a particular size and/or shape for the leg and cross piece members, and a general weakness of structure. Other sawhorse braces tend to hold the various members in a rigid manner, making the sawhorse inflexible so that it easily tips over when situated on uneven surfaces. Often tradesmen brace the two leg members together with a support from one leg member to the other, but this is unsatisfactory as with a weight load or on an uneven surface, the leg members tend to pull apart and collapse outward. The invention of this application solves this problem by providing a rear brace plate, which joins the top horizontal channel to each leg member at a point lower than the usual junction of the two leg members, just below the top channel of a brace, creating a compound angle arrangement and a significantly stronger support.

U.S. Pat. No. 5,377,780 discloses an assembly comprised of a main bracket having an inverted Y-shape with two downwardly inclined open-bottom channels to receive the leg members and an open-top channel to receive the auxiliary bracket which receives the cross piece. The improved function offered by this bracket is its ability to be folded flat. But it offers no more stability than a sawhorse with no brace or bracket. The '780 patent depends solely on the fasteners to prevent side-to-side shifting. The improved structure of Applicant's Heavy Duty Sawhorse Brace is the additional support that is the result of the compound angles used to position the leg members.

The truss brace in U.S. Pat. No. 1,780,579 teaches an elongated top horizontal channel for the cross piece which offers more stability than the traditional sawhorse but does not go far enough. The truss brace does not have a rear brace plate nor does it use the compound angles that are included in Applicant's sawhorse which eliminates end-to-end and side-to-side instability.

U.S. Pat. No. 1,797,543 (the '543 patent) discloses a bottom plate (25) that cannot be interpreted to be both a part of the top horizontal U-shaped channel and the brace plate. If the '543 patent is interpreted to have a top horizontal U-shaped channel, it does not also have a brace plate. Furthermore, even if the bottom plate (25) were a brace plate, there is no way that the bottom plate (25) could be construed to be connected to a top horizontal U-shaped channel, as is required of the brace plate of the present application. If the bottom plate (25) is a brace plate, then there is no top horizontal U-shaped channel in the Bryan reference.

The '543 patent does not teach the use of a brace plate. The bottom plate (25) set forth in the '543 patent is a part of the top horizontal U-shaped channel. Since the '543 patent does not teach a brace plate, it would not be obvious to one of ordinary skill in the art to combine the '543 patent with U.S. Pat. No. 4,457,399 to strengthen a brace plate by orienting that brace plate at an angle askew to a first axis and to a vertical line through a top channel.

The present invention satisfies a long felt need for a sawhorse brace that allows the user to employ the lumber and fasteners on hand to construct a sawhorse of superior strength and stability which virtually eliminates end-to end and side-to-side wobble without sacrificing the ease of assembly or affordability that have made the sawhorse a staple of the construction scene. More specifically, although the lumber used must be of a determined width to fit into the brace, the lumber may be of an undetermined depth so that a more stable and stronger sawhorse may be constructed from lumber with an increased depth. This needed invention is presently lacking in the prior art.

SUMMARY OF THE INVENTION

The invention is a heavy-duty sawhorse brace, comprised of a top horizontal channel to hold the cross piece of the sawhorse, two side leg channels and a brace plate. The top horizontal channel is U-shaped channel, with holes for nails or screws to secure the cross piece. The side leg channels are likewise U-shaped and have holes to secure the leg members. The brace plate is triangular in shape and extends from the top horizontal channel to each of the side leg channels. The brace plate and the length of the channels give the sawhorse increased stability by eliminating end-to-end shifting as well as increasing side-to-side stability. The brace plate in the preferred embodiment is connected at the free end of the sawhorse between the top horizontal channel and the side leg channels. However, it could be connected between those elements on the inside of the sawhorse. In either case, it is improved and new for the top horizontal channel to be elongated and extend beyond the point of connection between the top horizontal channel and the side leg channels to provide an angle for the brace plate to connect between the two.

The present invention may therefore be summarized in a variety of ways, one of which is the following: a sawhorse brace including an elongated top horizontal channel having a U-shaped cross section and a first axis, a pair of side leg channels, each of said pair of side leg channels having a U-shaped cross section and second and third axes respectively, each leg of said pair of side leg channels connected to said top horizontal channel and projecting downwardly therefrom, a brace plate, said brace plate connected to said top horizontal channel and to each leg of said pair of side leg channels, each leg of said pair of side leg channels being aligned with said top horizontal channel such that the second and third axes are at an angle askew to a line perpendicular to said first axis and askew to a vertical line running through said top horizontal channel, said top horizontal channel and said side leg channels having holes for fasteners to join a cross piece and leg members. The brace wherein said brace plate is connected to said top horizontal channel at a point remote from the point of connection of the legs of said pair of side leg channels to said top horizontal channel. The brace wherein said brace plate is connected to the side legs of said pair of side leg channels at a point remote from the point of connection of the legs of said side leg channels to said top horizontal channel. The brace wherein said brace plate is connected to the side legs of said pair of side leg channels at a point remote from the point of connection of the legs of said side leg channels to said top horizontal channel. The brace wherein said brace plate attaches said top horizontal channel to said side leg channels at a point remote from the point of connection of said legs to said top horizontal channel. The brace wherein said brace plate is oriented at an angle askew to said first axis and to a vertical line extending through said top horizontal channel. The brace wherein said brace plate is oriented at an angle in the range of ten to twenty degrees from a vertical line extending through said top horizontal channel. The brace wherein said brace plate is oriented at an angle of substantially fifteen degrees from a vertical line extending through said top horizontal channel. The brace wherein said brace plate is connected to the top horizontal channel at least four inches from the point of connection of said side leg channels to said top horizontal channel. The brace wherein said brace plate is connected to each said side leg channel at a point at least four inches below the point of connection of said side leg channels to said top horizontal channel. The brace wherein the leg members in said side leg channels have an included angle of at least thirty degrees. The brace further including key slots in said top horizontal channel such that fasteners may be used to secure a cross piece in position in said horizontal channel and said cross piece may easily be disassembled. The brace further including key slots in said side leg channels such that fasteners may be used to secure leg members in position within the channels of said side leg channels while allowing said leg members to be easily disassembled. The brace further including key slots in said side leg channels such that fasteners may be used to secure leg members in position within the channels of side leg channels while allowing said leg members to be easily disassembled.

Yet another way of summarizing the present invention is: an assembled sawhorse including a cross piece, four leg members, a pair of sawhorse braces, each brace including an elongated top horizontal channel having a U-shaped cross section and a first axis, a pair of side leg channels, each of said pair of side leg channels having a U-shaped cross section and second and third axes respectively, each leg of said pair of side leg channels connected to said top horizontal channel and projecting downwardly therefrom, a brace plate, said brace plate connected to said top horizontal channel and to each leg of said pair of side leg channels, each leg of said pair of side leg channels being aligned with said top horizontal channel such that the second and third axes are at an angle askew to a line perpendicular to said first axis and askew to a vertical line running through said top horizontal channel, said top horizontal channel and said side leg channels having holes for fasteners to join a cross piece and leg members. The brace wherein said cross piece and said leg members are 2×4 boards of wood which are positioned such that said 2×4s fit into said top horizontal channel and said side leg channels to form the sawhorse. The brace wherein said first leg member is in a plane and said second leg member is in a plane and said planes have an included angle of at least thirty degrees. The brace wherein said side leg channels have stops to prevent said leg members from protruding from the top of said side leg channels.

DESCRIPTION OF THE PREFERRED EMBODIMENTS

The brace of the invention is presented with particular reference to its use in constructing a conventional sawhorse. The brace is particularly constructed to be used with 2×4 wood leg members and cross piece members but could be constructed to accommodate other sizes of wood and other materials.

Figure 1:
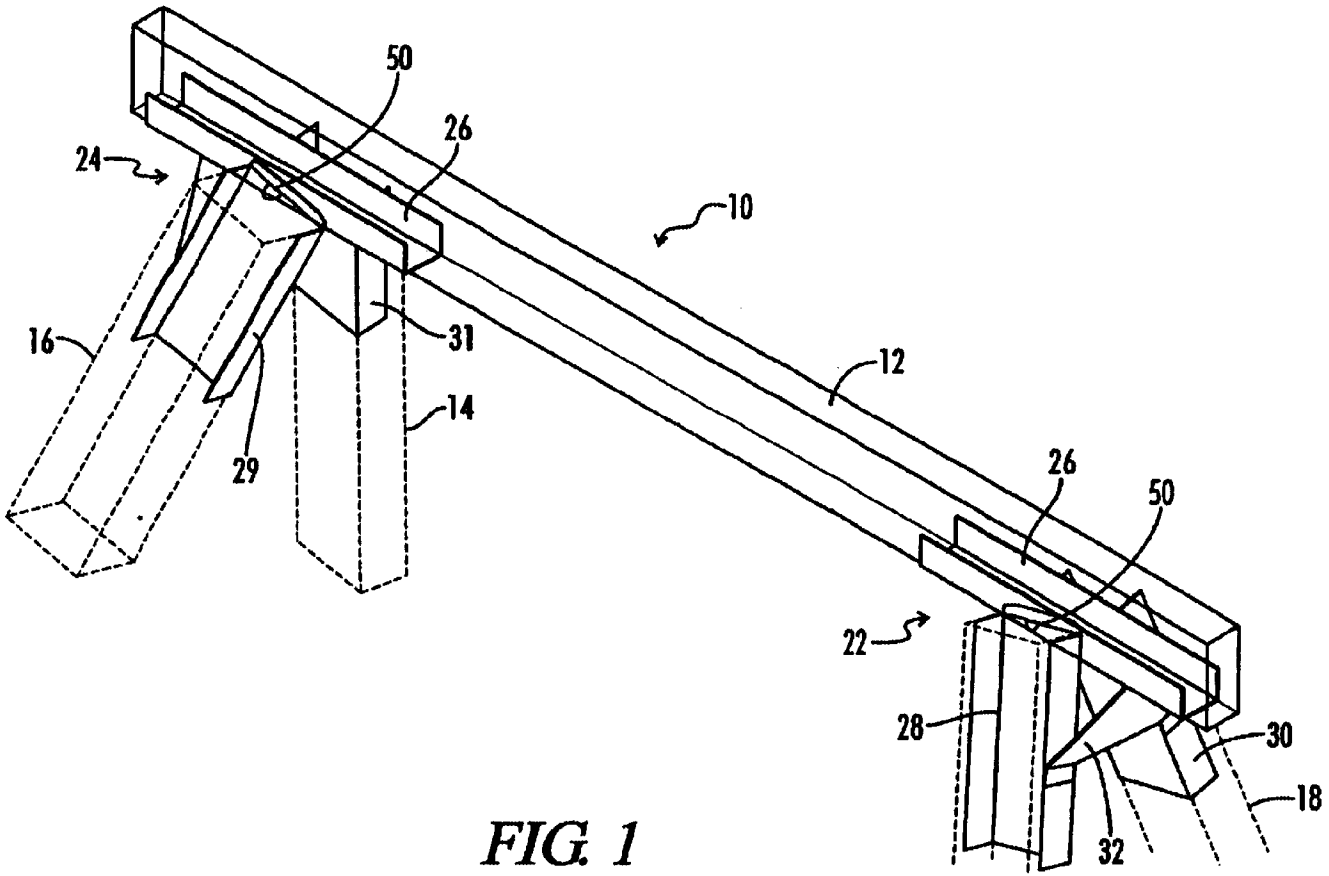
FIG. 1 is a perspective view of a sawhorse with the brace of the invention in use.

FIG. 1 shows a sawhorse 10 comprised of a cross piece member 12, four leg members 14, 16, 18, 20, and two braces 22, 24. This figure illustrates how the various members are positioned within the channels of the brace and secured with fasteners to form a sawhorse.

Figure 2:
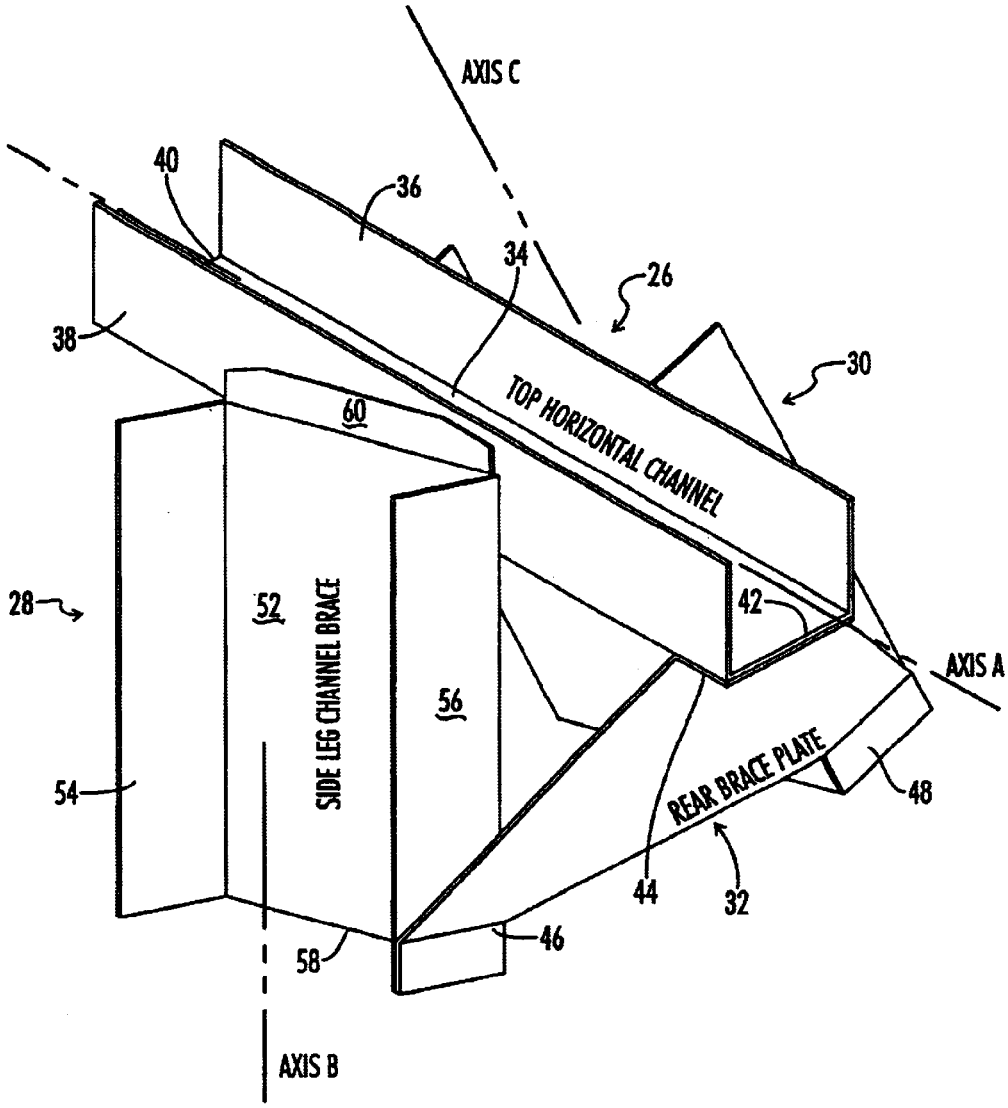
FIG. 2 is a perspective view of the brace assembly.

With reference to FIG. 2, the braces 22, 24 each consist of four parts: a top horizontal channel 26 on an axis a, a first side leg channel 28 on an axis b, a second side leg channel 30 on an axis c and a rear brace plate 32. The brace is comprised of 18 gauge steel, either composed of four separate pieces that are welded together, or folded from a single piece of steel. The side leg channels 28, 30 are attached to the top horizontal channel 26. The top horizontal channel is elongated and has opposing ends 40, 42. Each side leg channel connects to the top horizontal channel intermediate the opposing ends. The side leg channel 28 is attached to the top horizontal channel 26 by means of a tab 60 which is welded to the outer side wall 38 of the top horizontal channel. The tab 60 is at an angle from the side leg channel to accommodate the incline of the leg member. Similarly the side leg channel 30 is attached to the top horizontal channel 26 by means of a tab welded to the opposing outer side wall 36 of the top horizontal channel. The rear brace plate 32 is connected to the top horizontal channel at the end of the channel 42 that points away from the center of the cross piece. The top of the rear brace plate has a tab 44 which meets with the bottom surface of the top horizontal channel. Typically this tab 44 would bee welded to the top horizontal channel where they meet.

The top horizontal channel 26 is elongated and U-shaped. It is dimensioned to receive the crosspiece member of the sawhorse, with one edge of the crosspiece mating with the bottom face 34 of the top horizontal channel. The cross piece is positioned such that the sidewalls 36, 38 of the top horizontal channel face the wider faces of the crosspiece. As can be seen best from FIG. 1, the side walls are dimensioned such that they do not reach the top of the crosspiece. In this way the U-shape of the channel receives the cross piece member while leaving one edge and parts of both faces of the cross piece exposed. This allows for versatility in the size of the wood utilized for the crosspiece member.

In the configuration shown in FIGS. 1 and 2, the end 40 of the top horizontal channel 26 extends in the direction of the center of the sawhorse and the end 42 points away from the center of the sawhorse. The top horizontal channel is longer than other sawhorse braces with its length extending away from the center of the cross piece, past the intersection of the leg members and cross piece. This length provides greater end-to-end support than braces in the prior art.

Figure 6:
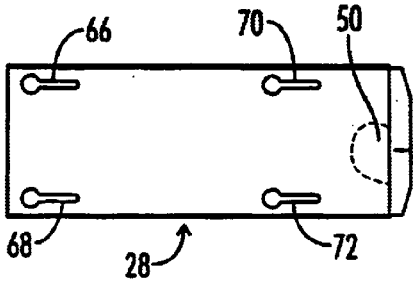
FIG. 6 is a view of the side leg channel.

The side leg channels 28, 30 are constructed in a manner like that of the top horizontal channel. The side leg channels are similarly U-shaped and elongated, but are dimensioned to receive the leg members in a way opposite that of the top horizontal channel. The leg members are received up to the point of the stop 50 as seen in FIGS. 1 and 6. The stop 50 prevents the leg members from protruding from the side leg channels 28, 30 in a way that would impair the operation of the top horizontal channel 26. As seen in FIG. 1, a leg member 20 meets the side leg channel 28 so that its wider face mates with the bottom face of the channel. The sidewalls of the side leg channel meet the edges of the leg member, but do not completely cover the entire edges.

The rear brace plate 32 is triangular in shape, connecting to the end 42 of the top horizontal channel and extending downward to connect with each side leg channel 46, 48. The rear brace plate 32 has its narrowest point at the place where it joins the top horizontal channel, with its width increasing with its length. In the preferred embodiment, the rear brace plate connects to the top horizontal channel and to each side leg channel at points at least four inches from the point of connection of the top horizontal channel and the side leg channels. The rear brace plate 32 connects to the bottom of the top horizontal channel by means of a top tab 44 and likewise connects to each side leg with tabs 46, 48 welded to the outer sidewall of the side leg channel. In the preferred embodiment, the rear brace plate 32 is oriented at an angle of in the range of ten to twenty degrees from a vertical line extending through the top horizontal channel. However, the rear brace plate could be oriented such that it is at a right angle with the top horizontal channel. Either way, it is this additional triangular connection between the cross piece and the leg members at a point lower than their first intersection that provides the greatly increased stability of the invention. The connection with the top horizontal channel prevents the leg members from spreading when large loads are applied to the sawhorse.

Figure 3:
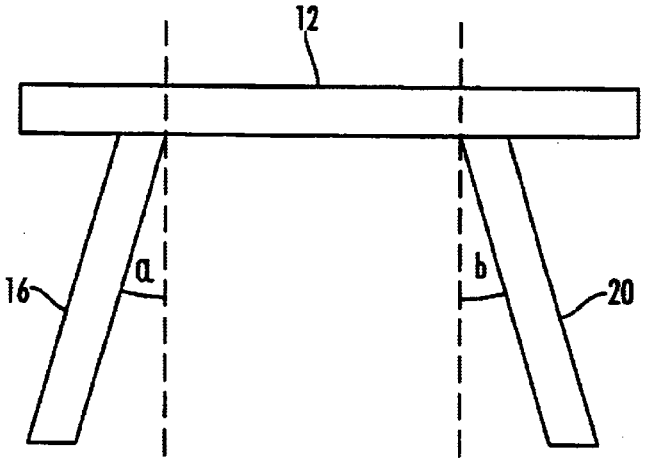
FIG. 3 is a side view schematic of a sawhorse.
Figure 4:
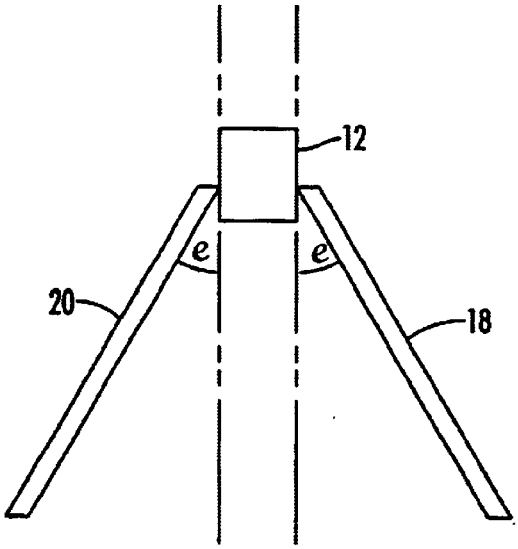
FIG. 4 is an end view schematic of a sawhorse.

FIGS. 3 and 4 illustrate the compound angles utilized in the alignment of the leg members. Our design makes use of compound angles in the arrangement of the leg members to increase the stability of the sawhorse. As shown in FIG. 3, the side leg channels are positioned such that the leg members 16, 20 do not form right angles with the cross piece 12 but tilt away from the center of the cross piece at an angle b. Angle b should be in the range of ten to twenty degrees with fifteen degrees being the preferred embodiment. FIG. 4 shows an end view of a sawhorse, with leg members 18, 20 at an angle e from the vertical axis. Angle e should be in the range to ten to twenty degrees, with the preferred embodiment using a fifteen degree angle. The compound angle arrangement of the leg members eliminates end-to-end shifting without compromising side-to-side stability. The rear brace plate makes it feasible to use the compound angles as it prevents any possible spreading or collapse of the leg members.

Figure 5:
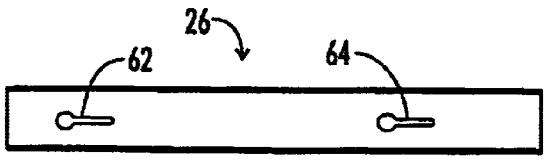
FIG. 5 is a view of the top horizontal channel.

The invention is such that screws or nails may be used as fasteners to join the brace to the sawhorse members. This is provided for with holes in each channel for fasteners. FIG. 5 illustrates the position of the fastener holes in the top horizontal channel 26. There are provided two key slots 62, 64 in the bottom face of the top horizontal channel 26, one at each end. While either nails or screws may be used, the design is such that by using screws as fasteners, the sawhorse could be easily disassembled for transportation and storage. The design is such that a screw would be positioned to first go through the top horizontal channel 26 and then into the wood, with the head of the screw on the outside of the channel. The use of key slots provides portability as it allows the screws to be loosened, allowing the cross piece 12 to slide out of the top horizontal channel 26 with the head of the screw passing through the large end of the key slot. In this manner the sawhorse can be taken apart for easy transport or storage and quickly reassembled by simply sliding the cross piece into the channel and tightening the screws when they are positioned at the small end of the key slot.

The side leg channels also make use of the key slot for fastener holes. As best shown in FIG. 6, each side leg channel 28, 30 has four key slots 66, 68, 70, 72 in its bottom face, two at each end. The key slots provide the same ease of disassembly for the leg members.

Thus, although there have been described particular embodiments of the present invention of a new and useful Heavy Duty Sawhorse Brace, it is not intended that such references be construed as limitations upon the scope of this invention except as set forth in the following conclusory statement of invention.

What is claimed is:

1. A sawhorse brace to connect leg members and a cross piece to form a sawhorse, including:

a) an elongated top horizontal channel having a U-shaped cross section and a first axis;

b) a pair of side leg channels, each of said pair of side leg channels having a U-shaped cross section and second and third axes respectively;

c) each of said pair of side leg channels connected to said top horizontal channel and projecting outwardly therefrom;

d) a brace plate;

e) said brace plate connected to each side leg channel of said pair of side leg channels at a location spaced from an upper portion of each side leg channel;

f) each of said pair of side leg channels being aligned with said top horizontal channel such that the second and third axes are at an angle askew to a line perpendicular to said first axis and askew to a vertical line running through said top horizontal channel;

g) said top horizontal channel and said side leg channels having holes for fasteners to join a cross piece and leg members; and h) said brace plate being connected to said top horizontal channel at a point spaced from the point of connection of said pair of side leg channels to said top horizontal channel.

2. The device of claim 1 wherein said brace plate is connected to said pair of side leg channels at a point remote from the point of connection of said side leg channels to said top horizontal channel.

3. The device of claim 1 wherein said brace plate attaches said top horizontal channel to said side leg channels at a point remote from the point of connection of said side leg channels to said top horizontal channel.

4. The device of claim 1 wherein said brace plate is oriented at an angle askew to said first axis and to a vertical line extending through said top horizontal channel.

5. The device of claim 1 wherein said brace plate is oriented at an angle in the range of ten to twenty degrees from a vertical line extending through said top horizontal channel.

6. The device of claim 1 wherein said brace plate is oriented at an angle of substantially fifteen degrees from a vertical line extending through said top horizontal channel.

7. The device of claim 1 wherein said brace plate is connected to the top horizontal channel at least four inches from the point of connection of said side leg channels to said top horizontal channel.

8. The device of claim 7 further including key slots in said side leg channels such that fasteners may be used to secure leg members in position within the channels of side leg channels while allowing said leg members to be easily disassembled.

9. The device of claim 1 wherein said brace plate is connected to each said side leg channel at a point at least four inches below the point of connection of said side leg channels to said top horizontal channel.

10. The device of claim 1 wherein the second and third axes are at an angle to each other and said angle is at least thirty degrees.

11. The device of claim 1 further including key slots in said top horizontal channel such that fasteners may be used to secure a cross piece in position in said horizontal channel and said cross piece may easily be disassembled.

12. The device of claim 1 further including key slots in said side leg channels such that fasteners may be used to secure leg members in position within the channels of said side leg channels while allowing said leg members to be easily disassembled.

13. An assembled sawhorse including:

a) a cross piece;

b) four leg members;

c) a pair of sawhorse braces;

d) each brace including:

a) an elongated top horizontal channel having a U-shaped cross section and a first axis;

b) a pair of side leg channels, each of said pair of side leg channels having a U-shaped cross section and second and third axes respectively;

c) each of said pair of side leg channels connected to said top horizontal channel and projecting downwardly therefrom;

d) a brace plate;

e) said brace plate connected to each of said pair of side leg channels, the location of said brace plate connection being distanced from the upper portion of said side leg channels;

f) each of said pair of side leg channels being aligned with said top horizontal channel such that the second and third axes are at an angle askew to a line perpendicular to said first axis and askew to a vertical line running through said top horizontal channel;

g) said top horizontal channel and said side leg channels having holes for fasteners to join said cross piece and said leg members; and h) said brace plate is connected to said top horizontal channel at a point spaced from the point of connection of said pair of side leg channels to said top horizontal channel.

14. The device of claim 13 wherein said cross piece and said leg members are 2 inch by 4 inch boards of wood which are positioned such that said leg members fit into said top horizontal channel and said side leg channels to form the sawhorse.

15. The device of claim 13 wherein each of said leg members in each of said sawhorse braces lies in a different plane and said planes have an angle between them of at least thirty degrees.

16. The device of claim 13 wherein said side leg channels have stops to prevent said leg members from protruding from the top of said side leg channels.

* * * * *